United States Patent [19]

Duttera et al.

[11] 4,347,127

[45] Aug. 31, 1982

[54] APPARATUS AND METHOD FOR FROTH FLOTATION SEPARATION OF THE COMPONENTS OF A SLURRY

[75] Inventors: James Duttera, Springfield; Raymond P. Jefferis, III, Gladwyne; David Matteson, Media; Alexander Szentlaszloi, Westchester, all of Pa.

[73] Assignee: Gulf & Western Manufacturing Company, New York, N.Y.

[21] Appl. No.: 230,059

[22] Filed: Jan. 29, 1981

[51] Int. Cl.[3] ..... B03D 1/02; B03D 1/14

[52] U.S. Cl. ..... 209/164; 209/168; 210/706; 210/221.2

[58] Field of Search ..... 209/164, 165, 168, 170; 210/221.2, 703, 706, 707, 205, 209

[56] References Cited

U.S. PATENT DOCUMENTS

| | | | |
|---|---|---|---|
| 2,416,066 | 2/1947 | Phelps | 209/168 |
| 2,983,377 | 5/1961 | Singleton | 209/164 |
| 3,015,396 | 1/1962 | Quast | 210/221.2 X |
| 3,400,818 | 9/1968 | Tarjan | 209/170 |

OTHER PUBLICATIONS

Perry, Ed., Chemical Engineers Handbook, McGraw-Hill, NY, NY, 1963, pp. 18-63, 18-68.

Bull. No. KSB 123-7909, Komline-Sanderson, Peapack, NJ 9/79.

Dwg. No. 7120, Spraying Systems Co., Wheaton, Ill. 12/73.

*Primary Examiner*—Ralph J. Hill

*Attorney, Agent, or Firm*—Scully, Scott, Murphy and Presser

[57] ABSTRACT

An improved method and apparatus for froth flotation separation of the components of a slurry, having particular utility for the beneficiation of coal by the flotation separation of coal particles from impurities associated therewith such as ash and sulfur. In this arrangement, a primary spray nozzle is positioned above a flotation tank having a water bath therein, and sprays an input slurry through an aeration zone into the surface of the water. The spraying operation creates a froth on the water surface in which a substantial quantity of particulate matter is floating, while other components of the slurry sink into the water bath. A skimming arrangement skims the froth from the water surface as a cleaned or beneficiated product. Moreover, a recycling operation is provided wherein particulate materials which do not float after being sprayed through the primary spray nozzle are recycled to a further recycle spray nozzle to provide a second opportunity for recovery of the recycled particles.

19 Claims, 3 Drawing Figures

APPARATUS AND METHOD FOR FROTH FLOTATION SEPARATION OF THE COMPONENTS OF A SLURRY

BACKGROUND OF THE INVENTION

1. Field of the Invention

The present invention relates generally to a method and apparatus for froth flotation separation of the components of a slurry, and more particularly pertains to an improved method and apparatus for beneficiating coal by flotation separation of ground coal particles from impurities associated therewith such as ash and sulfur.

Coal is an extremely valuable natural resource in the United States because of its relative abundant supplies in this nation. It has been estimated that the United States has more energy available in the form of coal than in the combined natural resources of petroleum, natural gas, oil shale, and tar sands. Recent energy shortages, together with the availability of abundant coal reserves and the continuing uncertainties regarding the availability of crude oil, have made it imperative that methods for converting coal into a more useful energy source be developed.

2. Discussion of the Prior Art

Known prior art processes for froth flotation separation of a slurry of particulate matter are based on constructions wherein air is introduced into the liquid slurry of the particulate matter as, e.g. through a porous cell bottom or a hollow impeller shaft, thereby producing a surface froth. These prior art methods are relatively inefficient approaches especially when large concentrations of particulate matter are being processed. Generally, these techniques are inefficient in providing sufficient contact area between the particulate matter and frothing air. As a result large amounts of energy can be expended in frothing. In addition, froth flotation techniques which permit bubbles to rise in the slurry can tend to trap and carry impurities, such as ash in the froth slurry, and accordingly the such as ash in the froth slurry, and accordingly the resultant beneficiated particulate product can have more impurities therein than necessary.

Methods have been suggested and are being explored in the beneficiation of coal, i.e., the cleaning of coal of impurities such as ash and sulfur, either prior to burning the coal or after its combustion. In one recently developed technique for beneficiation, termed herein chemical surface treating, raw coal is pulverized to a fine mesh size and is then chemically treated. According to this technique the treated coal is then separated from ash and sulfur, and a beneficiated or cleaned coal product is recovered therefrom.

In further detail, in the heretofore mentioned chemical surface treating process coal is first cleaned of rock and the like, and is then pulverized to a fine size of about 48 to 300 mesh. The extended surfaces of the ground coal particles are then rendered hydrophobic and oleophilic by a polymerization reaction. The sulfur and mineral ash impurities present in the coal remain hydrophilic and are separated from the treated coal product in a water washing step. This step utilizes oil and water separation techniques, and the coal particles made hydrophobic can float in recovery on a water phase which contains hydrophilic impurities.

SUMMARY OF THE INVENTION

Accordingly, it is a primary object of the present invention to provide an improved method and apparatus for froth flotation separation of a slurry of particulate matter. In greater particularity, it is a more detailed object of the present invention to provide an improved method and apparatus for beneficiating coal by a froth flotation separation of ground coal particles from impurities associated therewith such as ash and sulfur.

A further object of the subject invention is the provision of an improved method and apparatus for producing aeration in a flotation tank to generate a froth of particulate material such as carbonaceous particles, noncarbonaceous particles, or mixtures of both, coal particles, mine tailings, oil shale, residuals, waste particulates, mineral dressings, graphite, mineral ores, fines, etc.

Another object of the present invention is to provide a method and apparatus for froth flotation separatin which is more efficient and results in a cleaner product than prior art operations.

The foregoing objects are accomplished herein by a process which sprays the slurry through an aeration zone in which substantial quanties of air are sorbed by the sprayed fine droplets of the slurry. Accordingly, air is introduced into the froth in a manner which is quite different from prior art approaches. The advantages of this manner of froth generation make the teachings herein particularly applicable to froth flotation separation of slurries which have a substantial proportion of particulate matter therein.

In accordance with the teachings herein, the present invention provides an improved method and apparatus for froth flotation separation of the components of a slurry having particulate matter therein which is to be separated. In this arrangement, at least one primary spray nozzle is positioned above a flotation tank having a liquid bath therein, and sprays an input slurry of particulate matter through an aeration zone into the liquid surface. The spraying operation creates a froth on the liquid surface having a substantial quantity of particulate matter floating therein, while other components of the slurry and a minor quantity of particulate matter sink in the liquid bath. A collector trough is positioned in the tank below the primary spray nozzle(s) for collecting the sinking materials. The collected materials are then recycled to at least one recycle spray nozzle positioned above the tank which resprays them through an aeration zone into the liquid surface. In summary, the present invention operates in an efficient manner by providing a recycling operation wherein particles which do not float after being sprayed through a primary spray nozzle are recycled to a further spray nozzle to provide a second opportunity for recovery. In one embodiment the recycle spray nozzle(s) is positioned in proximity to the primary spray nozzle(s), and a vertical baffle plate is positioned in the tank between the primary and recycle nozzles to provide separation for materials sinking from the sprays of the respective nozzles.

In accordance with further details of one embodiment of the present invention, a skimmer arrangement having a plurality of spaced skimmer plates depending from a conveyor is arranged along the top of the tank to skim the resultant froth therefrom. An upwardly inclined surface extends from the water surface in the tank to a collection tank arranged at one side of the flotation tank, and the skimmer plates skim the froth from the water surface up the inclined surface and into the collection tank. Moreover, in one embodiment the primary and recycle spray nozzles are inclined from a vertical in the direction in which the skimmer arrangement operates to direct the flow of froth in that direction along the water surface. Settling impurities are removed from the flotation tank by a circulating arrangement operating near the bottom of the collection tank which removes bath water and the settling impurities.

The present invention operates in an efficient manner providing more effective cleaning of particulate matter such as coal and higher product recoveries by providing that those particles which do not initially float are resprayed into the water surface to promote and provide a high probability of secondary recovery of the product from waste materials.

While the froth flotation system of the present invention is described in detail herein in the context of a coal beneficiating operation, it is apparent that the teachings herein have direct applicability to other applications of froth flotation separation technology. For instance, the froth flotation separation techniques diclosed herein can be utilized in conjunction with particulate matter such as carbonaceous particles, noncarbonaceous particles, or mixtures of both, mine tailings, oil shale, residuals, waste particulates, mineral dressings, graphite, mineral ores, fines, etc.

BRIEF DESCRIPTION OF THE DRAWINGS

The foregoing objects and advantages of the present invention for an arrangement for froth flotation separation may be more readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE PRESENT INVENTION

The apparatus and method of the present invention is adapted to the separation of a wide variety of solid-fluid streams by the creation of a solids containing froth phase, and is suitable for the separation of many types of particulate matter. U.S. patent applications Ser. Nos. 114,357 and 114,414, both filed on Jan. 22, 1980, and U.S. patent application Ser. No. 22,622 filed concurrently herewith are incorporated herein by reference, and may be referred to for further details on the chemical processes which are particularly useful in conjunction with the subject invention.

Figure 1:
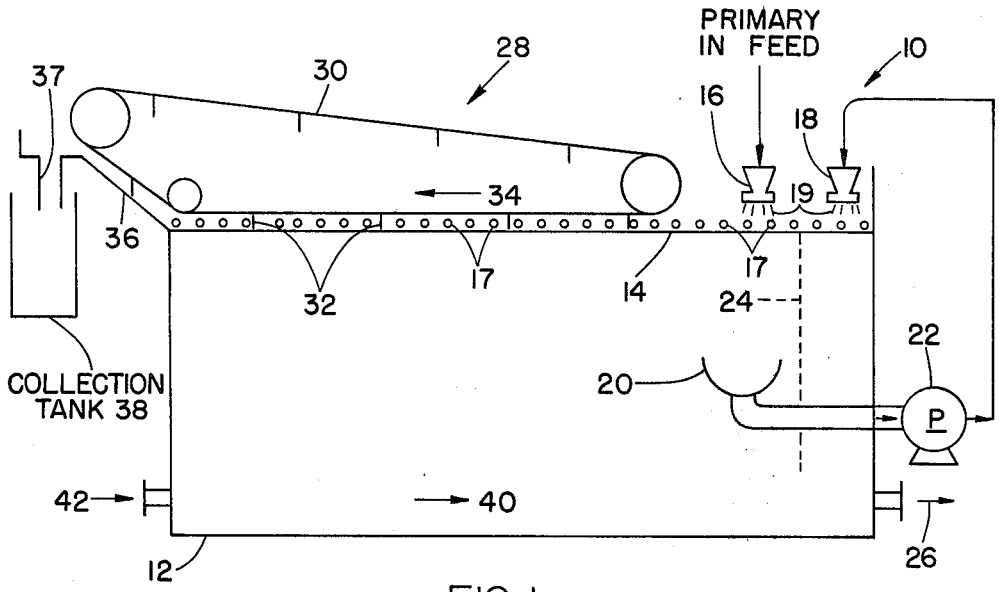
FIG. 1 is an elevational view of a schematic exemplary embodiment of a flotation arrangement constructed pursuant to the teachings of the present invention.

The present invention is described herein with reference to a coal beneficiating operation as disclosed in detail in the aforementioned patent applications. Thus, referring to the drawings in greater detail, FIG. 1 illustrates a first embodiment 10 of the present invention having a flotation tank 12 filled with water to level 14. In operation a slurry of finely ground coal particles, associated impurities, compound, and if desired additional additives such as monomeric chemical initiators, chemical catalysts and fluid hydrocarbons is sprayed through at least one primary spray nozzle 16 positioned at a spaced apart distance above the water level in tank 12. In alternative embodiments, two or more primary nozzles can be used to spray slurry and/or any other desired ingredients into the tank 12.

The stream of treated coal is pumped under pressure through a manifold to the primary spray nozzle 16 wherein the resultant shearing forces spray the coal flocculent slurry as fine droplets such that they are forcefully jetted into the mass of a continuous water bath in tank 12. High shearing forces are created in nozzle 16, and the dispersed particles forcefully enter the surface of the water and break up the coal-oil-water flocs thereby water-wetting and releasing ash from the interstices between the coal flocs and breaking up the coal flocs so that exposed ash surfaces introduced into the water are separated from the floating coal particles and sink into the water bath. The surfaces of the finely divided coal particles now contain air sorbed in the atomized particles, much of which is entrapped by spraying the slurry through an aeration zone 19 such that air is sorbed in the sprayed slurry. The combined effects on the treated coal caused the flocculated coal to decrease in apparent density and to float on the surface of the water bath. The hydrophilic ash remains in the bulk water phase, and tends to settle downwardly in tank 12 under the influence of gravity.

The present invention utilizes a froth generation principle in which the slurry is sprayed through an aeration zone such that substantial quantities of air are sorbed by the sprayed fine droplets of the slurry. Accordingly, air is introduced into the slurry in a unique manner to generate the resultant froth. The advantages of this manner of froth generation make the teachings herein particularly applicable to froth flotation separation of slurries which have a substantial proportion of particulate matter therein. The basic aeration concept described herein utilizing a spray nozzle to promote frothing and high recoveries of beneficiated particulate matter is disclosed and claimed in copending U.S. patent application Ser. No. 22,636 filed concurrently herewith.

The present invention provides a recycling operation to improve efficiency. In the recycling operation coal particles which do not float after being sprayed through primary spray nozzle 16 are recycled to a further recycle spray nozzle 18 to provide the coal particles a second opportunity for recovery. In this arrangement a collector trough 20, preferably in the form of an open hemispherical pipe, is positioned in tank 12 beneath the primary spray nozzle(s) 16 for collecting the sinking materials. A pump 22 is coupled to trough 20 and functions to draw settling materials into the trough from which it is pumped under pressure to the recycle spray nozzle(s). At least one recycle spray nozzle 18 is provided above the tank for respraying into the surface of the water bath the materials collected by the trough such that coal particles collected therein are recycled and a portion of the recycled coal floats as a froth on the water surface an additional time and is recovered. The recycled spray nozzle(s) 18 is positioned in proximity to the primary spray nozzle(s) 16, and a vertical baffle plate 24 is positioned in the tank 12 between the primary and recycle nozzles to provide separation for materials sinking from the sprays of the respective nozzles. In alternative embodiments further stages of recycling may be provided by adding additional troughs and recycle nozzles in the tank.

This arrangement results in an efficient operation, providing more effective cleaning of the coal and higher product recoveries by providing that coal particles which do not initially float have a high probability of being resprayed onto the water surface to promote secondary recovery of the product from waste materials.

After the recycling operation, the materials which sink from the recycle spray tend to settle downwardly in tank 12 under the influence of gravity, and are withdrawn in an ash-water stream 26 from the base of the vessel.

The coal particles in the floating froth 17 created by nozzles 16 and 18 are removed from the water surface by a skimming arrangement 28 in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward a surface 36, preferably upwardly inclined, extending from the water surface to a collection tank 38 arranged at one side of the flotation tank, such that the skimmer plates 32 skim the froth from the water surface up the surface 36 and into the collection tank 38.

In the arrangement of the disclosed embodiment, the waste disposal at the bottom of the tank operates in a direction 40 flowing from an influent stream 42 to the effluent stream 26, while the skimmer arrangement at the top of the tank operates in direction 34, counter to that of the waste disposal arrangement. Although the illustrated embodiment shows a counterflow arrangement, alternative embodiments are contemplated within the scope of the present invention having cross and concurrent flows therein.

Figure 2:
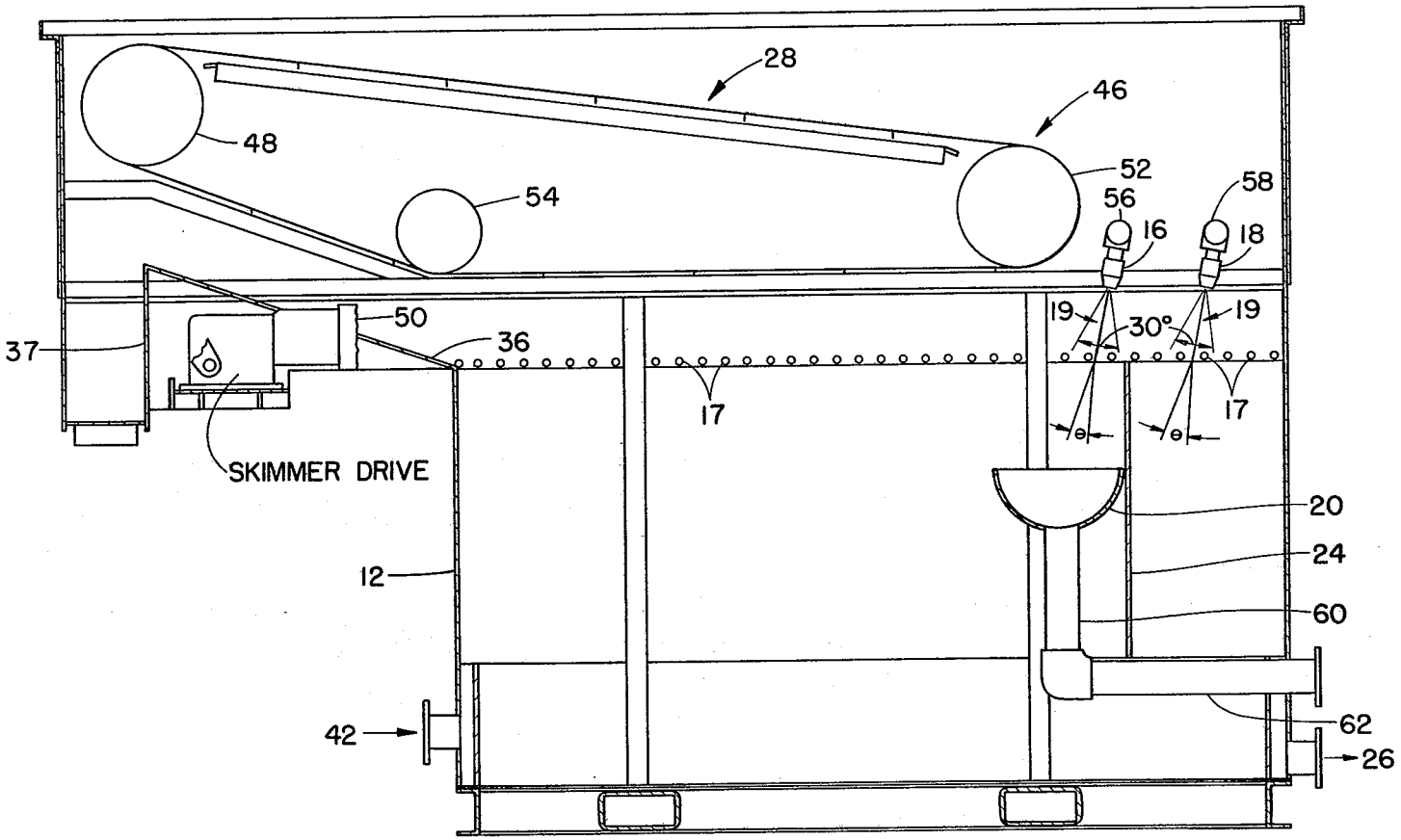
FIG. 2 illustrates an elevational view of a more detailed embodiment of a flotation tank constructed pursuant to the teachings herein.

FIG. 2 illustrates an elevational view of a more detailed illustration of a second embodiment of a flotation arrangement 46 pursuant to the teachings herein. Tank 12 may be a conventional froth flotation tank commercially available from KOM-LINE-Sanderson Engineering Co., Peapack, N.J. modified as set forth below. The base of the tank can be supported in a conventional manner by channel and flanged structural members, as illustrated. The flotation tank can also include somewhat standard equipment which is not illustrated in the drawings such as a liquid level sensor and control system and a temperature sensing and control system.

The conveyor system in this embodiment includes a drive roller 48 at one end, driven by a chain or equivalent linkage from a skimmer drive 50 mounted on the tank. The other end of the conveyor is defined by an idler roller 52 which in combination with a second idler roller 54 defines a horizontal run for the conveyor along the top of the flotation tank. The conveyor belt in this design is defined by two strands of two inch, double pitch chain with each strand having ninety-six pitches. Twelve skimmer plates are carried by the two chains, with each plate being eight pitches apart on the two conveyor chains. The bottom run of the conveyor arrangement is positioned approximately ten inches above the water surface, and each plate depends downwardly from the conveyor chains approximately ten inches to the water surface. The skimmer plates carry the coal bearing froth up an inclined surface 36 to a chute 37 through which the froth is directed to a collection tank.

Trough 20 is in the form of an open hemispherical pipe positioned below the area at which the spray from the primary spray nozzle 16 impinges on the water, and is coupled by lengths of vertical and horizontal conduits 60 and 62 to pump 22, not shown in FIG. 2, which in turn supplies recycle manifold 58 with a slurry at a preferred feed pressure.

Figure 3:
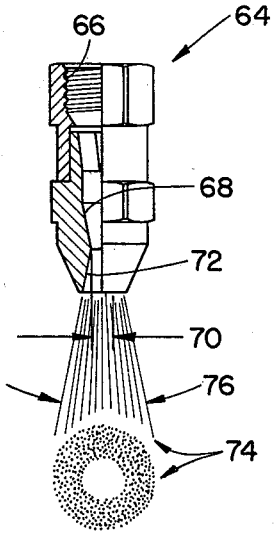
FIG. 3 is a partially sectional elevational view of one type of spray nozzle which can be utilized in the embodiments of FIGS. 1 and 2.

FIG. 3 is a partially sectional view of one type of commericially available spray nozzle 64 which may be used in conjunction with the systems shown in FIGS. 1 and 2. A recessed threaded coupling 66 is provided to attach the nozzle to a primary or recycle manifold supplying the nozzle with slurry under pressure. The slurry encounters a frustoconical venturi section 68 which accelerates the flow velocity thereof according to the well known venturi effect. The slurry then flows through the nozzle aperture, having a nominal diameter 70, which in combination with a diverging section 72 defines a hollow cone spray pattern 74 having an encompassing spray angle 76. In one preferred embodiment of the present invention, angle 76 is approximately thirty degrees.

Spray nozzle 64 may be a hollow jet nozzle as is commercially available from Spraying Systems Co., Wheaton, Ill. Of course it is contemplated herein that other types of nozzles, which function to provide the desired results as hereinbefore described, can also be used. The nozzles are preferably constructed of stainless steel, ceramic or other suitable hard metal to avoid erosion by the various particles in the slurry being pumped therethrough. The nozzles are preferably supplied with slurry in the supply manifolds at a pressure in the range of 5 to 40 psi, and more preferably in a pressure range of 15 to 20 psi.

Each nozzle may be tilted at an angle $\theta$ with respect to a vertical, as shown in FIG. 2, such that it functions to direct the flow of froth in that direction towards the skimmer arrangement 28. However, the angle $\theta$ does not appear to be critical, and the vertical positioning shown in FIG. 1 may be preferred to create a condition best conducive to agitation and froth generation at the water surface. It appears to be important that the agitation created by the nozzle sprays define a zone of turbulence extending a limited distance beneath the water surface level. Too much turbulence may actually reduce the amount of frothing produced at the water surface. The depth of the turbulence zone may be adjusted by varying the supply pressure of the slurry in the supply manifolds and also the distance of the nozzles above the water surface. In one operative embodiment, a zone of turbulence extending two to four inches beneath the water surface produced very good agitation and froth generation, although the distance is dependent on many variables and accordingly may vary considerably in other embodiments.

While several embodiments and variations of a method and apparatus for froth flotation separation of the components of a slurry have been described in detail herein, it should be apparent that the teachings and disclosure of the present patent will suggest many other embodiments and variations to those skilled in this art.

What is claimed is:

1. Apparatus for froth flotation separation of the components of a slurry having particulate matter therein which is to be separated, said apparatus comprising:

a. a flotation tank including means for withdrawing a floating fraction and means for withdrawing a tailings fraction;

b. means for feeding slurry comprising at least one primary spray nozzle adapted to cause a diverging spray, said spray nozzle positioned above said flotation tank and further adapted to spray under pressure input slurry of particulate matter so that said particulate matter is dispersed through an aeration zone of increasing cross sectional area into a liquid surface in the tank to create a froth on the surface;

c. a collector means positioned in said tank below said feed means for collecting sinking materials; and d. at least one recycle spray nozzle positioned above said tank for spraying said collected sinking materials through an aeration zone into the liquid surface.

2. Apparatus for froth flotation separation of the components of a slurry as claimed in claim 1, wherein said means for withdrawing said floating fraction includes a skimmer means, adapted to operate along the top of said tank, for skimming froth from the liquid surface of the tank.

3. Apparatus for froth flotation separation of the components of a slurry as claimed in claim 2, wherein said skimmer means includes a plurality of spaced skimmer plates depending from a conveyor arranged along the top of said tank, and an upwardly inclined surface extends from the top of said flotation tank to a collection tank arranged at one side of the flotation tank, whereby the skimmer plates skim the froth from the liquid surface up said inclined surface and into said collection tank.

4. The apparatus as defined in claim 1 wherein said at least one recycle spray nozzle is adapted to cause a diverging spray.

5. Apparatus for froth flotation separation of the components of a slurry as claimed in claim 1, wherein said means for withdrawing a tailings fraction includes circulating means, operating near the bottom of said tank, for removing liquid and settling materials therefrom.

6. Apparatus for froth flotation separation of the components of a slurry as claimed in claim 1, wherein said at least one primary and recycle nozzles are inclined from a vertical to assist in directing the flow of froth over the liquid surface.

7. Apparatus for froth flotation separation of the components of a slurry as claimed in claim 1, wherein said at least one recycle spray nozzle is positioned in proximity to said at least one primary spray nozzle, and a vertical baffle plate is positioned in said tank between said primary and recycle spray nozzles to provide separation for materials sinking from the sprays of the primary and recycle spray nozzles.

8. Apparatus for froth flotation separation of the components of a slurry as claimed in claim 1, further including an additional collector means positioned in said tank below said at least one recycle spray nozzle for collecting the sinking materials from its spray, and a further recycle spray nozzle positioned above said tank for spraying through an aeration zone into the liquid surface the materials collected by said additional collector means, whereby several stages of recycling are provided.

9. Apparatus for froth flotation separation of the components of a slurry as claimed in claims 1 or 2 or 3 or 5 or 6 or 7 or 8, further including means for supplying a slurry of coal particles and impurities associated therewith to said at least one primary spray nozzle, whereby the apparatus is utilized for the beneficiation of coal.

10. A method for froth flotation separation of the components of a slurry having particulate matter therein which is to be separated, said method comprising the steps of:

a. spraying under pressure an input slurry of particulate matter through a means for feeding slurry, said means for feeding slurry comprising a primary spray nozzle adapted to cause a diverging spray so that said particulate matter is dispersed through an aeration zone into a liquid surface to create a froth on the surface having a substantial quantity of particulate matter floating therein, while other components of the slurry and a minor quantity of particulate matter sink in the liquid, whereby the froth can be removed from the liquid surface;

b. collecting said sinking materials from the spray of the primary spray nozzle in a collector means positioned below said feed means;

c. utilizing a recycle spray nozzle to respray through an aeration zone into the liquid surface said collected sinking materials, whereby particulate matter therein is recycled and a portion of the recycled material floats as a froth on the liquid surface;

d. withdrawing said froth formed in steps a and c; and e. withdrawing a tailings fraction.

11. A method for froth flotation separation of the components of a slurry as claimed in claim 10, further including the step of skimming the froth from the liquid surface.

12. A method for froth flotation separation of the components of a slurry as claimed in claim 11, wherein said skimming step is accomplished utilizing a plurality of spaced skimmer plates depending from a conveyor arranged along the liquid surface.

13. A method for froth flotation separation of the components of a slurry as claimed in claim 10, wherein said step of utilizing a recycle spray nozzle is carried out in proximity to said step of utilizing a primary spray nozzle, and further including the step of providing a vertical baffle plate in the liquid between the positions at which the steps of utilizing a recycle spray nozzle and utilizing a primary spray nozzle are performed, to provide separation for the sinking materials from both steps.

14. A method for froth separation of the components of a slurry as claimed in claim 10, further including the steps of collecting the sinking materials from the spray of the recycle spray nozzle, and utilizing a further recycle spray nozzle to respray the collected materials through an aeration zone into the liquid surface, whereby several stages of recycling are provided.

15. A method for froth separation of the components of a slurry as claimed in claim 10 or 11 or 12 or 13 or 14, further including the step supplying a slurry of coal particles and impurities associated therewith to said primary spray nozzle, whereby the method is utilized for the beneficiation of coal.

16. The method of claim 10 wherein said recycle spray nozzle is adapted to cause a diverging spray.

17. An apparatus for froth flotation separation of the components of a slurry having particulate matter therein which is to be separated, said apparatus comprising:

a. a flotation tank including means for withdrawing a floating fraction and means for withdrawing a tailings fraction;

b. means for feeding slurry comprising at least one primary spray nozzle for spraying an input slurry under pressure through an aeration zone, said primary spray nozzle positioned above said flotation tank and being adapted to spray a bulk of said input slurry as fine droplets through an aeration zone, which fine droplets are projected through said aeration zone and into the surface of a liquid in said flotation tank to form a froth phase on the surface of said liquid;

c. a collector means positioned in said tank below said feed means for collecting sinking materials; and d. at least one recycle spray nozzle positioned above said tank for spraying said collected sinking materials through an aeration zone into the liquid surface.

18. The apparatus for froth flotation separation of the components of a slurry as defined in claim 17, wherein said means for withdrawing a floating fraction comprises a skimmer means adapted to operate along the top of said tank for skimming froth from the liquid surface of the tank.

19. The apparatus for froth flotation separation of the components of a slurry as defined in claim 17 wherein said at least one recycle spray nozzle is adapted to spray said collected materials as fine droplets through said aeration zone.

* * * * *

UNITED STATES PATENT AND TRADEMARK OFFICE

CERTIFICATE OF CORRECTION

PATENT NO. : 4,347,127

DATED : August 31, 1982

INVENTOR(S) : James Duttera et al.

It is certified that error appears in the above-identified patent and that said Letters Patent are hereby corrected as shown below:

Column 2, Line 20 "separatin" should read --separation--;

Column 2, Line 25 "quanties" should read --quantities--; and

Column 3, Line 24 "diclosed" should read --disclosed--.

Signed and Sealed this

*Fourteenth* Day of *June 1983*

[SEAL]

*Attest:*

DONALD J. QUIGG

*Attesting Officer*

*Acting Commissioner of Patents and Trademarks*